US006628797B2

(12) United States Patent
Yamada

(10) Patent No.: US 6,628,797 B2
(45) Date of Patent: Sep. 30, 2003

(54) LOUDSPEAKER-AND-PRE-STRESSED CABINET

(75) Inventor: Teppei Yamada, Tokyo (JP)

(73) Assignee: N.P.L. Ltd., Tokyo (JP)

( * ) Notice: Subject to any disclaimer, the term of this patent is extended or adjusted under 35 U.S.C. 154(b) by 135 days.

(21) Appl. No.: 09/835,488

(22) Filed: Apr. 17, 2001

(65) Prior Publication Data

US 2002/0006210 A1 Jan. 17, 2002

(30) Foreign Application Priority Data

Jul. 13, 2000 (JP) ..... 2000-212863

(51) Int. Cl.[7] ..... H04R 25/00

(52) U.S. Cl. ..... 381/345; 381/336; 381/395; 181/153

(58) Field of Search ..... 381/87, 332, 336–339, 381/340, 341, 342, 345, 353, 386, 380, 392, 394, 395, FOR 138, FOR 141, FOR 143, FOR 146; 181/22, 152, 153–159, 186, 192, 199

(56) References Cited

U.S. PATENT DOCUMENTS 3,945,461 A * 3/1976 Robinson ..... 181/153
4,850,452 A * 7/1989 Wolcott ..... 181/199
5,082,084 A * 1/1992 Ye-Ming ..... 181/199
5,525,767 A * 6/1996 Fields ..... 181/153
5,864,100 A * 1/1999 Newman ..... 181/153
6,055,320 A * 4/2000 Wiener et al. ..... 381/338
6,377,696 B1 * 4/2002 Nevill ..... 381/338

FOREIGN PATENT DOCUMENTS

JP 2000-224682 8/2000 ..... H04R/1/02

* cited by examiner

*Primary Examiner*—Curtis Kuntz
*Assistant Examiner*—Suhan Ni
(74) *Attorney, Agent, or Firm*—Wenderoth, Lind & Ponack, L.L.P.

(57) ABSTRACT

Disclosed is an improved loudspeaker comprising a pre-stressed cabinet and a loudspeaker unit fixed to the inside of the cabinet. The cabinet comprises a hollow conical assembly including two conical bodies of high-rigidity metal, one press-fitted into the other by applying an increased compressive force. The hollow conical assembly has front and rear plates closing its front and rear openings. These front and rear plates are pulled toward each other by tightening screw rods.

5 Claims, 2 Drawing Sheets

LOUDSPEAKER-AND-PRE-STRESSED CABINET

BACKGROUND OF THE INVENTION

1. Field of the Invention

The present invention relates to a loudspeaker, and more particularly a loudspeaker cabinet.

2. Related Art

There have been a variety of proposals for suppressing undesired resonance in the loudspeaker cabinet, thereby allowing the sound to travel at an increased speed and rise at the beginning of sound reproduction. The loudspeaker cabinet is made of thick plates in the hope of suppressing undesired resonance in its closed space, but such loudspeaker cabinet is not satisfactory. The loudspeaker cabinet of ceramic is found satisfactory to some extent, but the shaping of the cabinet is difficult because of its hardness, and its heaviness is a problem, also. Still disadvantageously, it produces accompanying sound inherent to the material.

The inventor realized that undesired vibration is caused by deformation or distortion in the cabinet and that the cabinet if pre-deformed or pre-stressed is capable of preventing occurrence of significant resonance in its closed space. The inventor has proposed speaker cabinet of duralumin that is pre-stressed by using screw rods (see Japanese Patent 2000-224682(A)). The metal cannot be welded, and lacks ductility to and can thus be easily broken by bending. Such difficulty in workability makes it difficult to provide a cabinet structure that can be pre-stressed still more.

SUMMARY OF THE INVENTION

One object of the present invention is to provide a loudspeaker cabinet structure which can be so pre-stressed as to suppress undesired resonance effectively.

The inventor discovered that the stressing in the form of compression is most effective to suppress undesired resonance in the loudspeaker cabinet.

To attain this object a loudspeaker comprising a cabinet and a loudspeaker unit fixed to the inside of said cabinet is improved according to the present invention in that said cabinet comprises a hollow conical assembly comprising two conical bodies of high-rigidity metal, one press-fitted into the other; said hollow conical assembly having front and rear plates closing its front and rear openings.

The press-fitting of one of the high-rigidity conical bodies into the other by applying an increased pressure causes an extraordinary stress to occur in the hollow conical assembly far beyond the stress caused by pulling force. The conical body needs to be made of a sheet of metal of high-rigidity such as steel or duralumin of sufficient thickness.

The front and rear plates may be press-fitted in the front and rear openings of the hollow conical assembly, and these plates are circular disks whose circumferences converge inward, the larger diameters of the circular disks being somewhat larger than the diameters of the front and rear openings of the hollow conical assembly.

Use of circular disks whose circumferences converge inward assures that the circular disks be firmly pushed into the opposite openings of the hollow conical assembly, permitting application of strong pressure to the circular disks to cause compression stress in the hollow conical assembly.

The loudspeaker unit may be fixed to the front plate by tightening screw rods, thereby applying an increased compression stress to the loudspeaker unit.

Application of compression stress to the loudspeaker unit will effectively suppress undesired vibration of the loudspeaker unit of metal.

The front and rear plates may be pulled toward each other by tightening screw rods, thereby fixing the front and rear plates to the hollow conical assembly.

The tightening of the screw rods will keep the front and rear plates tightly fitted into the front and rear openings of the hollow conical assembly without allowing the looseness to appear in the front and rear closed ends of the hollow conical assembly.

The front and rear plates may be annular plates each having an inward converging aperture made at its center, and a disk fitted in the inward converging aperture; and the disks fitted in the front and rear plates may be pulled toward each other by tightening screw rods, thereby fixing the front and rear plates to the hollow conical assembly.

This arrangement will allow application of increased compression stress to the front and rear plates.

In assembling, a press machine is used in applying an extraordinary pressing force to one conical body to push it into the other conical body, thus providing a hollow conical assembly; and the front plate having the loudspeaker unit fixed thereto is press-fitted into the front opening of the hollow conical assembly with the aid of the press machine; and then the rear plate is press-fitted into the rear opening of the hollow conical assembly with the aid of the press machine, also.

Other objects and advantages of the present invention will be understood from the following description of two loudspeakers according to the present invention, which are shown in accompanying drawings.

DETAILED DESCRIPTION OF PREFERRED EMBODIMENTS

Figure 1:
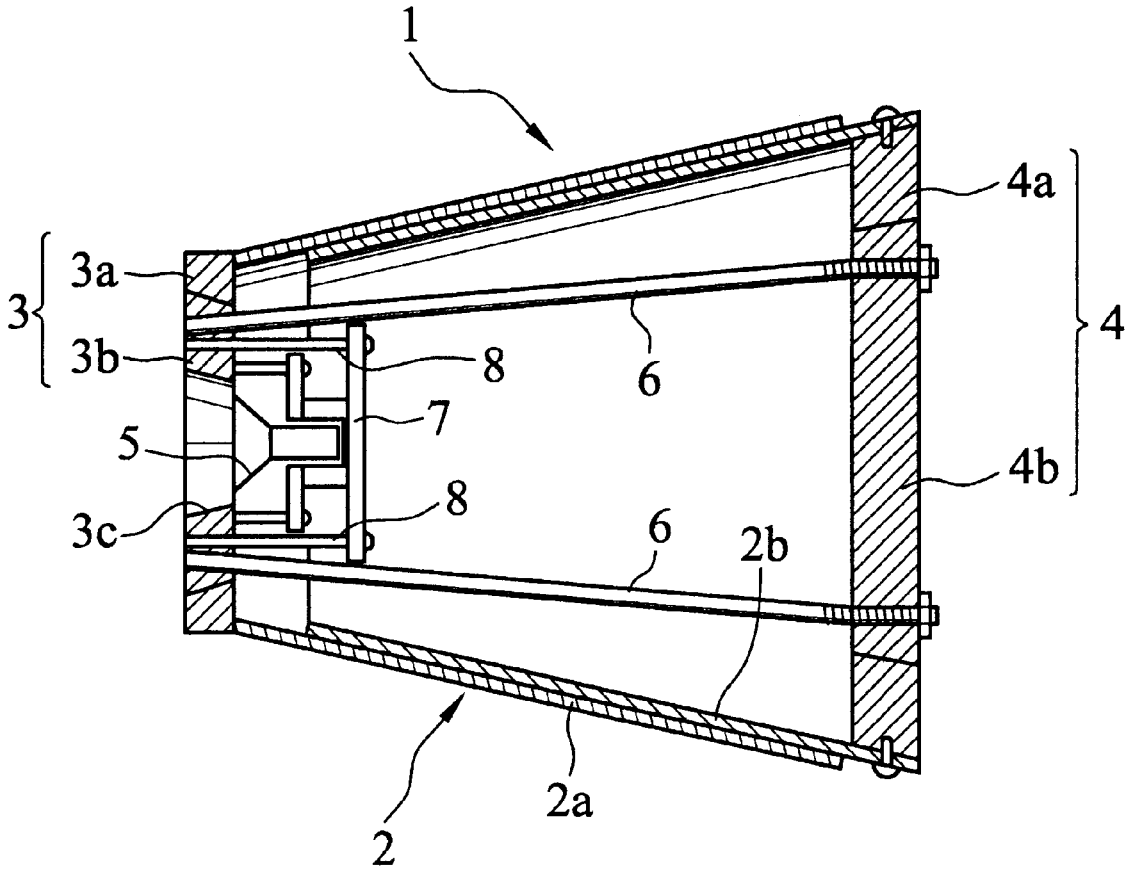
FIG. 1 is a longitudinal section of a loudspeaker according to a first embodiment.

Referring to FIG. 1, a loudspeaker 1 according to the first embodiment comprises a cabinet 2 and a loudspeaker unit 5 fixed to the inside of the cabinet 2. The cabinet 2 comprises a hollow conical assembly comprising two conical bodies 2*a* and 2*b* of high-rigidity metal telescoped with front and rear plates 3 and 4 closing its front and rear openings.

These conical bodies 2*a* and 2*b* are of almost the same shape and size, one press-fitted into the other. Each conical body is made of a sheet of metal of high-rigidity, and the sheet of metal is thick enough to provide good resistance to an increased strength of compression and effective suppression of undesired vibration. The tapering angle is so selected that an increased compression stress may occur. For one example, such hollow conical assembly is made of three-millimeter thick sheet of metal of high-rigidity, and it has a tapering angle of approximately two degrees.

A circular front plate 3 is welded to the front side of the hollow conical assembly 2 to close the front opening whereas a circular rear plate 4 is fixed to the rear side with screws to close the rear opening. Each plate is twenty millimeters thick. The front plate 3 comprises an outer annular plate 3*a* and an inner annular plate 3*b*, which is press-fitted in the outer annular plate 3*a*. The rear plate 4 comprises an annular plate 4*a* and a circular disk 4*b*, which is press-fitted in the annular plate 4*a*. Each annular plate 3*a* or 4*a* has an inward converging surface formed on its inner circular circumference, and each of the disk 3*b* and the inner annular plate 4*b* has an inward converging surface formed on its outer circumference.

As shown, the inner annular plate 3*b* and disk 4*b* are pulled toward each other by tightening four screw rods 6. One threaded end of each screw rod is threadedly engaged in the tapped hole made in the inner annular plate 3*b* of the front plate 3 whereas the other threaded end appears outward on the circular disk 4*b* of the rear plate 4 to be threadedly engaged with a nut.

A circular opening 3*c* is formed at the center of the inner annular plate 3*b* of the front plate 3 and the speaker unit 5 is fixed to the inner annular plate 3*b* at the periphery with screws. A backup plate 7 is applied to the rear side of the speaker unit 5 to push it to the front plate 3 by tightening four screws 8, which pass through the four corners of the backup plate 7 to be threadedly engaged with the tapped holes made in the inner annular plate 3*b*. Thus, compression stress appears in the metal part of the speaker unit 5 to suppress undesired vibration.

Figure 2:
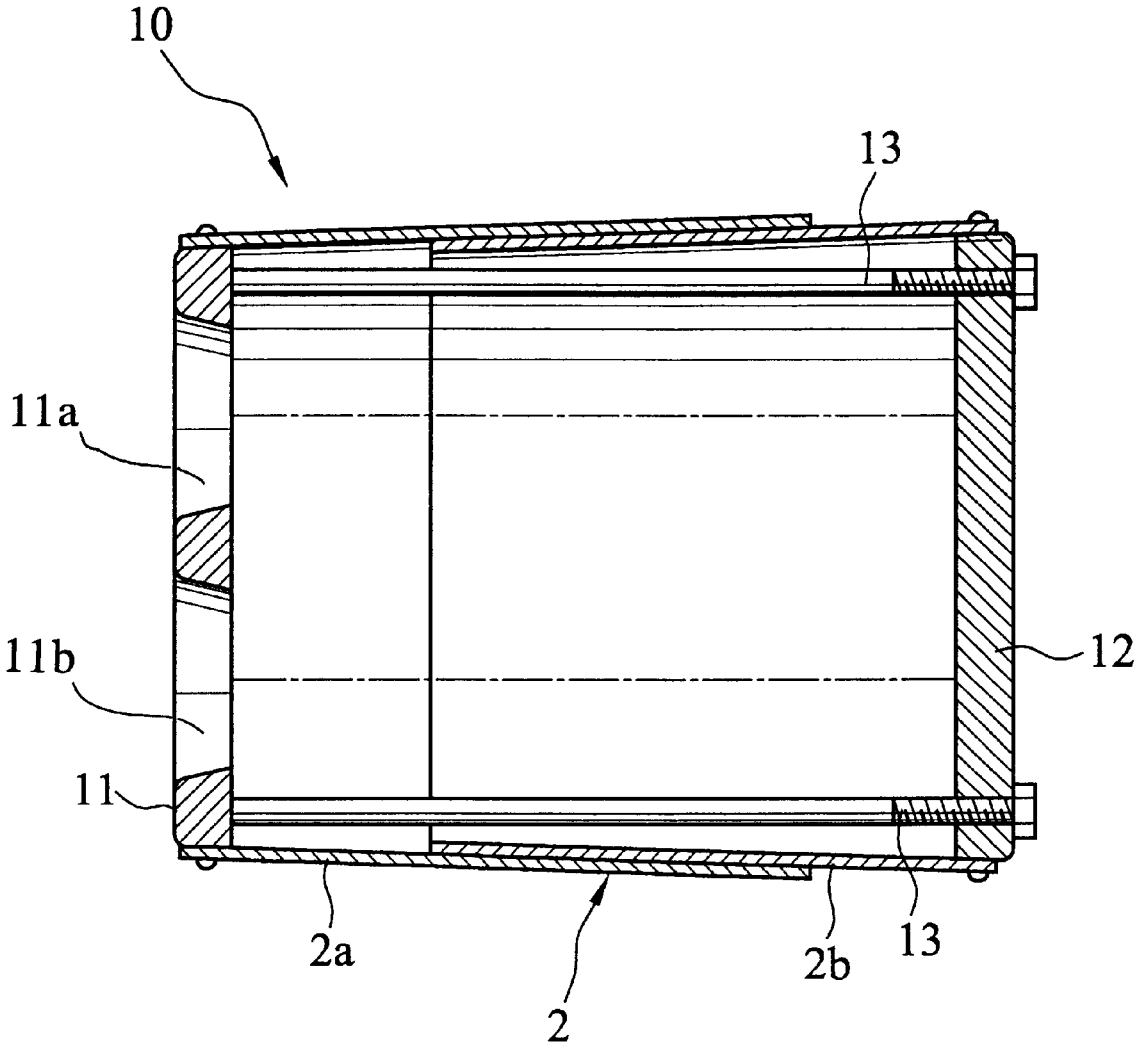
FIG. 2 is a longitudinal section of a loudspeaker according to a second embodiment.

Referring to FIG. 2, a loudspeaker cabinet 10 according to the second embodiment of the present invention, uses front and rear plates 11 and 12, each being a whole piece having no separate part. The front plate 11 is twenty millimeters thick, closing the front opening of the composite hollow conical body 2. It has two circular holes 11*a* and 11*b* made therein, and two loudspeaker units (not shown) are fixed to the circumferences of the circular holes 11*a* and 11*b* with screws. The rear plate 12 is a twenty-millimeter thick circular plate closing the rear opening of the composite hollow conical body 2.

The circumference of the plate 12 converges inward at the same angle as the conical body 2*b*, and the larger diameter of the rear plate 12 is somewhat larger than the diameter of the conical body 2*b*. The front opening end of the conical body 2*a* is chamfered on its inner circumference to diverge somewhat outward. The larger diameter of the front plate 11 is larger than the diameter of the front opening of the conical body 2*a*. Each plate 11 or 12 is press-fitted in the front or rear opening of the hollow conical assembly 2, and is fixed thereto with screws, thereby assuring that the hollow conical assembly 2 remain pre-stressed as it is.

The front and rear plates 11 and 12 are pulled toward each other by tightening two screw rods 13 so that the hollow conical assembly may be subjected to an increased compression stress. One end of each screw rod 13 is threadedly engaged with the tapped hole made in the front plate, and the other end of the screw rod 13 appearing on the rear plate 12 is engaged with the nut.

As may be understood from the above, the loudspeaker cabinet is put in a compressive-stressed condition, thus allowing the sound to travel at an increased speed in the cabinet and to rise quickly at the beginning of sound reproduction. Such a loudspeaker cabinet of excellent performance can be produced with ease and at low cost.

What is claimed is:

1. A loudspeaker comprising a cabinet and a loudspeaker unit fixed to the inside of said cabinet, wherein said cabinet comprises a hollow conical assembly comprising two conical bodies of high-rigidity metal, one press-fitted into the other; said hollow conical assembly having front and rear plates closing its front and rear openings; wherein said front and rear plates are press-fitted in the front and rear openings of said hollow conical assembly, and are circular disks whose circumferences converge inward, the larger diameters of said circular disks being somewhat larger than the diameters of the front and rear openings of said hollow conical assembly.

2. A loudspeaker according to claim 1, wherein said loudspeaker unit is fixed to the front plate by tightening screw rods, thereby applying a compression stress to said loudspeaker unit.

3. A loudspeaker according to claim 1, wherein said front and rear plates are pulled toward each other by tightening screw rods, thereby fixing said front and rear plates to said hollow conical assembly.

4. A loudspeaker comprising a cabinet and a loudspeaker unit fixed to the inside of said cabinet, wherein said cabinet comprises a hollow conical assembly comprising two conical bodies of high-rigidity metal, one press-fitted into the other; said hollow conical assembly having front and rear plates closing its front and rear openings; wherein said front and rear plates are annular plates each having an inward converging aperture made at its center, and a disk fitted in the inward converging aperture; and the disks fitted in the front and rear plates are pulled toward each other by tightening screw rods, thereby fixing said front and rear plates to said hollow conical assembly.

5. A loudspeaker according to claim 4, wherein said loudspeaker unit is fixed to the front plate by tightening screw rods, thereby applying a compression stress to said loudspeaker unit.

* * * * *